US006668584B1

(12) United States Patent
Tosti

(10) Patent No.: US 6,668,584 B1
(45) Date of Patent: Dec. 30, 2003

(54) HOUSING FOR SETTING A STONE IN JEWELRY

(76) Inventor: Giuliano Tosti, P.O. Box 480280, Ft. Lauderdale, FL (US) 33348

( * ) Notice: Subject to any disclaimer, the term of this patent is extended or adjusted under 35 U.S.C. 154(b) by 0 days.

(21) Appl. No.: 10/139,919

(22) Filed: May 7, 2002

(51) Int. Cl.[7] ..... A44C 17/02
(52) U.S. Cl. ..... 63/26
(58) Field of Search ..... 63/26, 29.1

(56) References Cited

U.S. PATENT DOCUMENTS

| | | | | | |
|---|---|---|---|---|---|
| 345,866 | A | * | 7/1886 | Smith | 24/114.11 |
| 795,109 | A | * | 7/1905 | Dover | 63/26 |
| 830,179 | A | * | 9/1906 | Sadler | 63/26 |
| 836,479 | A | * | 11/1906 | Allen | 63/26 |
| 1,295,109 | A | * | 2/1919 | Britt | 24/102 SL |
| 1,529,606 | A | * | 3/1925 | O'Donnell | 63/29.1 |
| 1,689,124 | A | * | 10/1928 | Fitzgerald | 63/29.1 |
| 1,864,371 | A | * | 6/1932 | Prussian | 63/29.1 |
| 2,069,598 | A | * | 2/1937 | Arpels | 63/29.1 |
| 2,141,363 | A | * | 12/1938 | Rigollet | 63/29.1 |
| 4,220,018 | A | * | 9/1980 | Chuard | 63/29.1 |
| 4,972,685 | A | * | 11/1990 | Poll | 63/26 |
| 5,218,839 | A | * | 6/1993 | Udko | 63/26 |
| 6,067,818 | A | * | 5/2000 | Winkler | 63/26 |
| 6,125,516 | A | * | 10/2000 | Winkler | 29/10 |

* cited by examiner

*Primary Examiner*—Andrea Chop

(57) ABSTRACT

A housing for setting a stone in jewelry having a bottom barrel shaped tube that may function as a locking element over any product. The bottom barrel shaped tube fits into a hole no larger than the diameter of the barrel tube waist and no smaller than the barrel bottom diameter. An upper housing has a stone seat formed to match the shape of any stone creating a compact metal-stone unit that is resistant to percussive action tools used for the assembly of this component over a piece of jewelry.

2 Claims, 2 Drawing Sheets

HOUSING FOR SETTING A STONE IN JEWELRY

BACKGROUND OF THE INVENTION

This invention relates generally to the field of jewelry stone assembly, and more particularly to a housing for setting a stone in jewelry.

In the past, stones have been mounted over precious metal by a skilled stone setter. As the watch industry grew, there was a need to assemble small diamonds over watch dials where the polishing and finishing of the setting needed to be done before the final assembly of the dial. In the 1960's, the production of large quantities of costume jewelry, watches and precious jewelry required the use of semi-precious or precious stones and the industry adopted the use of preset stones.

There are primarily two different productions: a basic or classic production, and production utilizing components with preset stones, called settings. Assembly of a preset stone over costume jewelry, watches and jewelry is performed by different techniques including solder, rivet, thread, glue and precision fit.

Most recently there was introduced a split housing with a stone loosely inserted and having a tube with indentations. When pressed inside the jewelry hole the component closed the split and locked the stone in place. For costume jewelry this system is accepted, but for precious jewelry with precious stones, the split is not desirable. In addition, the hole in the jewelry requires precise tolerances be adhered to.

The precision fit, or press fit technique, is a well-suited technique because the component is practically nailed down over the jewelry. However, it is not practical, because the close tolerances required between the hole of the finished product and the tube of the component is too critical to be achieved. Accordingly, the press fit technique is not generally used.

SUMMARY OF THE INVENTION

A primary object of the invention is to provide a housing for setting a stone in jewelry that may fit into a wider range of products not requiring precision tolerances.

Another object of the invention is to provide a housing for setting a stone in jewelry without the need of solder, glue, thread or a rivet.

A further object of the invention is to provide a housing for setting a stone in jewelry that can be locked in place by any percussion action tool such as a simple hammer.

Still yet another object of the invention is to provide a housing for setting a stone in jewelry that can be fastened onto jewelry with different wall thickness.

In accordance with a preferred embodiment of the present invention, a housing for setting a stone in jewelry comprises a lower tube portion of generally barrel shaped design, and an integral upper portion with a stone seat formed to match the shape of any desired stone.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
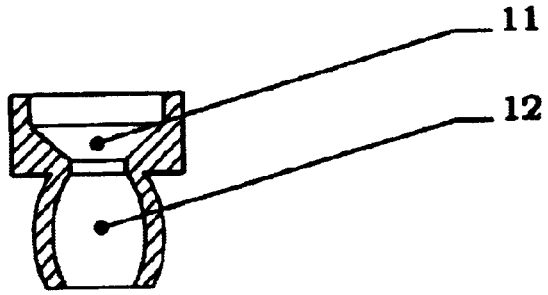
FIG. 1 is a cross-sectional view of a housing for setting a stone in jewelry in accordance with a preferred embodiment of the present invention having a seat set to match the shape of a stone.
Figure 2:
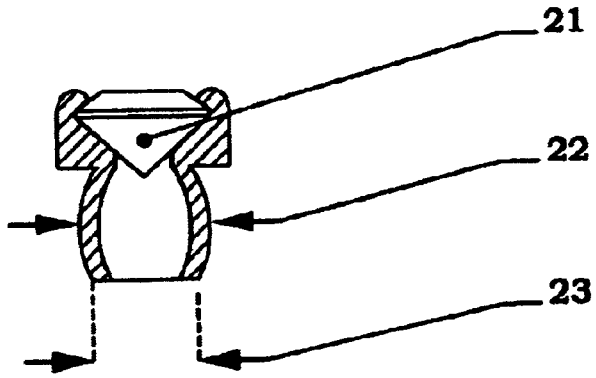
FIG. 2 is a cross-sectional view of a housing for setting a stone in jewelry of FIG. 1 having a stone set therein.
Figure 3:
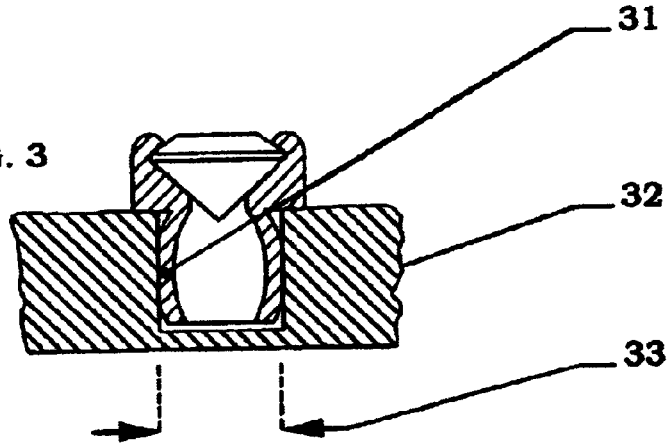
FIG. 3 is a cross-sectional view of a housing for setting a stone in jewelry of FIG. 1 inserted into a piece of solid jewelry.
Figure 4:
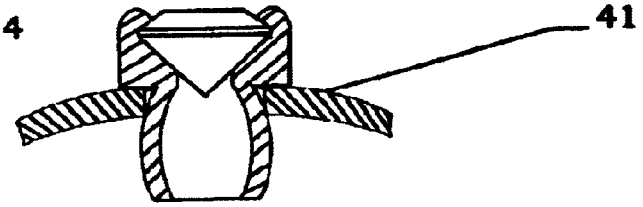
FIG. 4 is a cross-sectional view of a housing for setting a stone in jewelry of FIG. 1 inserted into a piece of hollow jewelry.
Figure 5:
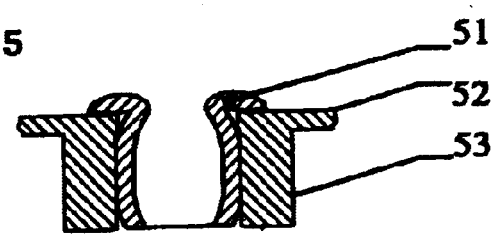
FIG. 5 is a cross-sectional view of a housing for setting a stone in jewelry used to fasten two components together in an alternate embodiment of the present invention.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The housing for setting a stone in jewelry has a barrel shaped tube functioning as a new locking device and is comprised of an upper housing 11 with a stone seat that matches the shape of the stone and a bottom part 5 with a barrel shaped tube 12 functioning as a locking device.

First, the stone 21 is preset into the housing 11. Then, the entire component with the preset stone has its bottom barrel shaped tube FIG. 12, forced into a jewelry hole 31, by a percussion tool hammering over the housing and the preset stone 31. A one-sized barrel tube can be applied into different wall thickness jewelry items as long as they have the same size hole.

The hole 32, 41 in the jewelry 33 does not require a close tolerance. It only needs to be no larger than the waist diameter 22 of the barrel shaped tube and no smaller than the bottom diameter 23 of the barrel shaped tube.

This type of press fit is normally achieved with precision tolerances and difficult execution. The present invention eliminates the difficulty of the execution because the tolerances requires are at least ten times less precise and the hole required only to be no larger than the waist diameter 22 of the barrel shaped tube and no smaller than the diameter of the bottom barrel shaped tube 23.

The component, having the stone housing that matches the shape of the stone, and the bottom barrel shaped tube, is made of precious metals such as gold, platinum, palladium and sterling silver.

Figure 6:
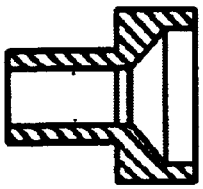
FIG. 6 is a cross-sectional view of a housing for setting a stone in jewelry showing the first stage of manufacture.
Figure 7:
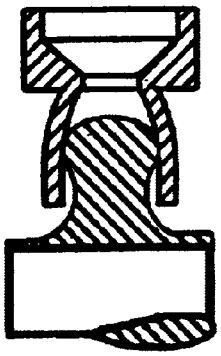
FIG. 7 is a cross-sectional view of a housing for setting a stone in jewelry showing the secondary stage of manufacture.
Figure 8:
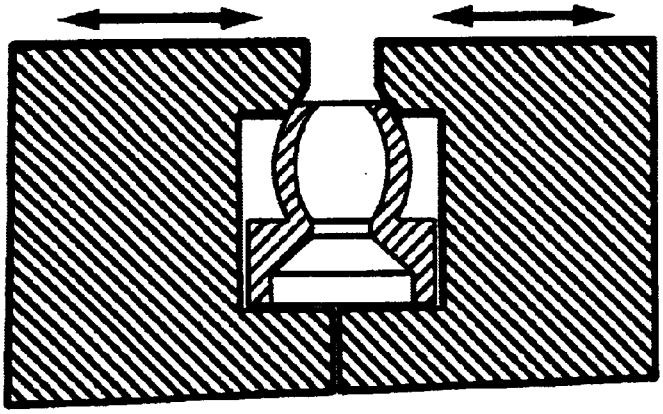
FIG. 8 is a cross-sectional view of a housing for setting a stone in jewelry showing the third and final stage of manufacture.

The manufacturing process of the component is performed in the following sequence. First, the component is produced from a solid rod or wire on an automatic lathe, which turns and cuts the initial components upper housing and the bottom tube-straight as in FIG. 6. Next, the component undergoes a secondary operation where a half-steel ball is inserted inside a tube forming the upper and middle side of the barrel shaped tube as shown in FIG. 7. Thereafter, the half ball is removed and a third and final operation is performed by a compression tool having two semicircular sections that are closing the bottom barrel shaped tube, as shown in FIG. 8.

In the preferred embodiment, the tolerance for the diameter of the stone during the stone setting process is plus or minus 0.05 mm for each size that will be applied, with a general wall thickness for the component ranging from 0.20 mm for the small sized stone up to 0.25 mm for the larger sized stone. As illustrated, the difference between the barrel waist diameter and the barrel bottom diameter is 0.20 mm with a tolerance range of plus or minus 0.01 mm.

The best known way the housing will fit and lock itself into any form of jewelry is by using a percussion tool such as an impact press. The hole tolerance in the jewelry will actually vary according to the characteristics of the material. For example to apply into titanium jewelry you will need to drill a hole that is 3% smaller than the waist diameter—because titanium has different machineabe properties compared to 14 karat gold, whereby the hole could be 5% smaller than the waist diameter.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A housing for setting a stone in a jewelry hole comprising: a lower seamless tube portion of barrel shaped design, having a wall of uniform thickness and an outwardly flared portion at a midpoint of the tube portion; and a unitarily formed upper portion defining a stone seat, said stone seat having an inner surface with a frustroconical portion and a cylindrical portion, said stone seat defining a shape to match the shape of a stone.

2. A housing for setting a stone in a jewelry hole as claimed in claim 1 wherein the barrel shaped lower seamless tube portion has some elasticity such that when the housing is forced into the jewel shaped lower seamless tube portion stretches and is frictionally fit against, within the wall of the jewelry hole and locks itself within.

* * * * *